US009458783B2

(12) United States Patent
Cerreto et al.

(10) Patent No.: US 9,458,783 B2
(45) Date of Patent: Oct. 4, 2016

(54) CARBURETION CONTROL SYSTEM

(75) Inventors: Nicola Cerreto, Bagnolo in Piano (IT); Marco Ferrari, Carpi (IT)

(73) Assignee: EMAK S.P.A., Bagnolo in Piano (Reggio Emilia) (IT)

( * ) Notice: Subject to any disclaimer, the term of this patent is extended or adjusted under 35 U.S.C. 154(b) by 293 days.

(21) Appl. No.: 14/236,737

(22) PCT Filed: Apr. 25, 2012

(86) PCT No.: PCT/IB2012/000814
§ 371 (c)(1),
(2), (4) Date: Feb. 3, 2014

(87) PCT Pub. No.: WO2013/017920
PCT Pub. Date: Feb. 7, 2013

(65) Prior Publication Data

US 2014/0180560 A1 Jun. 26, 2014

(30) Foreign Application Priority Data

Aug. 2, 2011 (IT) ..... RE2011A0060

(51) Int. Cl.
*F02D 7/00* (2006.01)
*F02D 41/06* (2006.01)
*F02D 35/02* (2006.01)

(52) U.S. Cl.
CPC ..... *F02D 41/062* (2013.01); *F02D 35/021* (2013.01); *F02D 2400/04* (2013.01); *F02D 2400/06* (2013.01)

(58) Field of Classification Search
CPC ..... F02D 35/0053; F02D 35/021
USPC ..... 123/435, 436, 674, 690, 701, 437
See application file for complete search history.

(56) References Cited

U.S. PATENT DOCUMENTS 4,100,897 A * 7/1978 Brettschneider .... F02D 35/0069 123/438
4,337,746 A * 7/1982 Masaki ..... F02D 41/1441 123/691
4,372,270 A * 2/1983 Latsch ..... G01N 27/68 123/703
4,535,740 A * 8/1985 Ma ..... F02P 5/1455 123/406.26
4,945,870 A * 8/1990 Richeson ..... F02B 75/02 123/179.21
6,029,627 A * 2/2000 VanDyne ..... F02D 35/021 123/435
6,125,691 A 10/2000 Hohner et al.
2003/0172907 A1* 9/2003 Nytomt ..... F02D 35/023 123/406.14
2004/0094124 A1* 5/2004 Viele ..... F02D 35/021 123/406.27
2007/0247164 A1* 10/2007 Bengtsson ..... F02P 1/086 324/393
2009/0132145 A1* 5/2009 Angeby ..... F02D 35/02 701/102

FOREIGN PATENT DOCUMENTS

DE 19735454 A1 2/1999
EP 1780536 A2 5/2007
WO 9605419 A1 2/1996
WO 9837322 A1 8/1998
WO 2007042091 A1 4/2007

* cited by examiner

*Primary Examiner* — Thomas Moulis
(74) *Attorney, Agent, or Firm* — Browdy and Neimark, PLLC

(57) ABSTRACT

System for controlling the carburetion of an internal combustion engine comprising the following activities: a) starting the engine; b) determining the factor λo using any known method; c) measuring the ionization current $ci_o$; d) modifying—from outside—the factor λ by a predefined amount equivalent to Δλ bringing it to the value $\lambda_1=\lambda_o+\Delta_\lambda$; e) repeating the measurement of the ionization current $ci_1$; f) calculating the value of the difference of the ionization current $A_{\lambda ci1}$ equivalent to $ci_o-Ci_1$; g) repeating operations d. and e. until the difference between the last value of the ionization current o,η and the second last value $ci_{n-1}$ is smaller than $\Delta_{ci}$; where $\Delta_{ci}$ is a predefined value which is assumed to have no influence with respect to the carburetion.

5 Claims, No Drawings

CARBURETION CONTROL SYSTEM

TECHNICAL FIELD

The present invention relates to the control of the carburetion in internal combustion engines.

The expression carburetion is used to indicate the comburent (air)/fuel ratio in the mixture supplied to the combustion chamber.

The correct fuel/comburent ratio is essential for the correct operation of the engine, i.e. giving a desired performance thereof, and for reducing the exhaust emissions and it is always in proximity of, but not exactly, the theoretical combustion ratio or stoichiometric ratio.

BACKGROUND ART

The parameter used for defining the combustion ratio is the factor λ which measures the excess air with respect to the stoichiometric ratio; λ=1 corresponds to the stoichiometric ratio, λ<1 indicates insufficient air, λ>1 indicates excess air.

The problem of controlling carburetion is particularly felt in small two-stroke engines, for example used for portable tools in the agricultural and woodlands industry, such as string trimmers, chainsaws and the like.

In the technical terminology, the expression "rich mixture" is used to indicate a mixture containing an excess amount of fuel, and the expression "weak mixture" is used to indicate a mixture containing an insufficient amount of fuel, where excess or insufficient amounts do not refer to the stoichiometric ratio, but to the desired correct combustion ratio compared to the conditions of use of the machine.

In practice the desired correct combustion ratio is never equivalent to the stoichiometric ratio, though very close thereto.

Both the maximization of the supplied power and the minimization of the polluting elements in the exhaust correspond to a correct combustion ratio in the desired conditions of use.

In small two-stroke engines, such as the ones used in portable tools, like chainsaws, parting tools, string trimmers or the like, it has been observed an optimal operating range corresponds to λ=0.85-0.95, i.e. a fuel mixture with slight air deficiency, i.e. a slightly "rich" mixture.

Values of λ lower than those indicated lead to a loss of power and excess exhaust fumes; greater values of λ instead lead to a hazardous overheating of the engine.

Thus, carburetion control is an essential activity for the sound operation of the internal combustion engine and several control systems are known.

Systems are known, for example described in document U.S. Pat. No. 6,029,627, which use the ionization current as the carburetion control parameter.

The ionization phenomenon starts within the combustion chamber where, due to the fuel oxidation reaction and due to the heat generated by the combustion, ions are generated.

In the presence of two differently charged poles arranged in the combustion chamber there occurs a migration of ions between the poles, referred to as the ionization current.

The use of the electrodes of the fuel mixture spark plug as poles is known.

The expression ionization current is used to indicate the current that passes between the two electrodes measured from outside.

The systems for measuring the current are known and thus they will not be described in detail.

The ionization current depends on several engine operation parameters and it may be considered as a function of two significant parameters, like the angular position of the crankshaft, i.e. the position of the piston in the cylinder, and the factor λ.

The angular position of the crankshaft is indicated by corresponding the top dead centre to 360°.

The ionization current diagram, as a function of the degrees of rotation of the drive shaft, has two peaks, the first due to the ions generated by the oxidation reaction (combustion) of the mixture and the second due to the ions generated by the amount of heat generated by the combustion.

The first peak always occurs, while the second peak occurs only when the engine generates a given power; thus it is not always available.

Said peaks are measured as a function of the degrees of rotation of the drive shaft, and the value thereof varies also as a function of λ.

For each value of λ we will thus have a given curve of the ionization current as a function of the degrees of rotation of the engine.

The ionization current diagram as a function of the factor λ has the peak for the value of λ close to 0.9 for small two-stroke engines.

The ideal carburetion occurs at the maximum peak of the ionization current as a function of the position of the drive shaft, this peak also varying as a function of λ; thus, the known methods provide for measuring—at each cycle—the value of the ionization current as a function of the position of the drive shaft and have a retroactive action on the value of λ to keep the value of the current close to the maximum value.

This method of operation is however difficult to apply in practice given that the variations of the value of the ionization current from the peak value are so low that they require very sensitive and sophisticated instruments, that are too expensive to use in the present field of application.

In document WO 98/37322 measurements are taken of the ionization signal (the ionization current) internally of the combustion chamber, and the factor λ is adjusted according to the signal.

The method for adjusting the λ uses the identification of a first and possibly a second peak in the ionization current and the maximisation of at least one of the peaks according to the ionizing current.

It can comprise a comparison between the peaks of current in the various cylinders of the engine.

The factor λ is modified by acting either on the butterfly valve or on the fuel injector.

The analysis of the ionization signal is done at the same time as the analysis of other significant parameters of the engine, among which the concentration of $O_2$ in the exhaust.

When dealing with small two-stroke engines (page 13 from line 9), the document confirms that the method comprises maximizing the first and the second peak of ionization in all the operating conditions of the motor (page 9, lines 23, 24), or the determining of the value of λ at which there is a misfire detection.

Misfire detection is obtained by progressively weakening the mixture, up to identifying the value of λ that causes it; the functioning is stabilized thanks to a return to a reasonably enriched mixture.

Document WO2007/042091 describes a method in which it seems essential to construct, for each cylinder, a λ curve according to the ionization current between the unleashing of the spark and the end of the ionic phenomenon.

The document also includes determining (from page 4, line 15) the value of λ on the curve, and a corrective value of λ which varies according to the type of engine and manufacturer.

The corrective value and the result of the difference between the value of λ registered in the preceding step and a predetermined registered value of λ.

Document WO96/05419 comprises a weakening or an enriching of the mixture up to respectively verifying non-start-up or piston slap, which parameters are extraneous to the method of the present invention.

DISCLOSURE OF INVENTION

The object of the present invention is to provide a system for controlling carburetion that can be easily implemented without requiring the use of sophisticated apparatus.

Said object is attained by a system having the characteristics mentioned in the independent claims.

The invention is based on the following principles.

Every engine leaves the factory provided with factory calibration settings, in which the conditions of use provided for are the standard conditions to which a given value of λ, to be indicated as $\lambda_0$, corresponds.

Thus, the value $\lambda_0$, corresponds to the ideal carburetion desired during calibration.

The actual use of the machine occurs under environmental, climatic or work conditions that may differ from the conditions under which the calibration was carried out, conditions under which the carburetion is no longer the ideal one. Thus, a new definition of λ is required.

According to the invention this occurs without bothering to maximise the peak of the ionization current, but using the variation of the ionization current as a function of a slight increase or decrease (optional) of the value of λ.

The variations of the ionization current bear no relation to the maximum peak of the ionization current, but they are estimated in absolute value, regardless of the point of the cycle at which they are read.

The value of λ is modified by a predefined amount in one of the known methods, for example by intervening on the fuel injection time or on the oxidiser air supply or on any other available parameters.

The injection time is the preferential but not exclusive parameter for modifying λ.

The value of the ionization current is recorded before every modification of the value of λ.

After modifying the λ, if the variation of the ionization current is comprised in the desired and predefined range, it means that the carburetion is correct.

The operation is repeated until there occurs a variation greater than the predefined range between the last and the second last reading of the ionization current.

At this point the value of λ is modified by the predefined amount but in the opposite sense and the carburetion is deemed to be ideally adjusted.

The control is repeated at regular intervals or preferably each time the environmental or meteorological conditions of use of the machine are deemed modified to a point of negatively affecting the carburetion.

Performing the control whenever starting the engine is deemed sufficient.

The advantages as well as the constructional and functional characteristics of the invention will be apparent from the detailed description that follows, which describes a particular preferred embodiment of the invention provided by way of non-limiting example.

BEST MODE FOR CARRYING OUT THE INVENTION

First and foremost, it should be observed that to each value of λ there corresponds a value of the percentage of CO in the exhaust gases, the relation between the two quantities being illustrated in the table below:

| | CO % | | | | | | | | |
|---|---|---|---|---|---|---|---|---|---|
| | 1 | 2 | 3 | 4 | 5 | 6 | 7 | 8 | 9 |
| Λ | 0.98 | 0.94 | 0.91 | 0.87 | 0.84 | 0.80 | 0.77 | 0.73 | 0.70 |

A two-stroke one-cylinder engine having the following data was used in the example below:

| | |
|---|---|
| Cylinder capacity | 40.2 cc |
| Maximum speed | 10500 rpm |
| Maximum power | 2.1 Hp |
| Operating speed | 8500 rpm |

Engine mapping was carried out from the start assuming use thereof at sea level with an operating temperature of around 20° C.

A value of $\lambda_0$ of 0.8 was adopted in these conditions, to which corresponds an emission of CO of 6% and an ionization current of $ci_0$=0.6 μA.

A variation of the ionization current with respect to the ionization current relating to the optimal conditions $\Delta_{rif} \leq 0.1$ μA is considered acceptable.

The variation of λ set from outside is selected equivalent to $\Delta\lambda \leq 0.05$.

The first use of the engine occurred at the altitude of 1500 meters above sea level, with an operating temperature close to 0° C.

Thus, the carburetion of the engine requires adjustment which is carried out as follows.

The factor λ is modified by a predefined amount equivalent to $\Delta_\lambda$, i.e. from the calibration value $\lambda_0$=x to the value $\lambda_1=\lambda+\Delta_\lambda$.

Then the ionization current is measured, which is $ci_1$=0.3 μA, as well as the difference $\Delta_{ci}$ between the values of the ionization currents $(ci_1-ci_0)$=0.3 μA.

If $\Delta_1$ is smaller than $\Delta_{rif}$, it can be deemed that $\lambda_1$ corresponds to a correct carburetion.

However, in order to, obtain a better regulation of the carburetion, it is suitable to repeat the operation with values of $\lambda_{1 \ldots n}$ until the difference between the last measured and the second last measured ionization current ($ci_n$ and $ci_{n-1}$) exceeds the value $\Delta_{rif}$.

The second last value $I_{n-1}$ is restored at this point and this value is considered correct.

This allows selecting, among acceptable values of λ, the one closest to the rich mixture.

It is clear that if on the first modification of $\lambda_0$ obtained a variation of the ionization current $<\Delta_{rif}$ is obtained, the value of $\Delta_0$ is considered correct.

The previously described method can be implemented by means of electronic measurement devices known to those skilled in the art.

For example a sensor will be provided that is suitable for reading the value of the ionization current, as well as a microprocessor suitable for calculating the difference $\Delta_{ci}$ between the last two read values, and comparing it with the value $\lambda_{rif}$.

The subsequent use of the engine occurred at sea level, with operating temperature close to −10° C.

Thus, the engine carburetion requires adjustment, which is performed as follows.

The factor $\lambda$ is modified by a predefined amount equivalent to $\Delta_{\lambda}$, i.e. from the value of calibration $\lambda_0$=x to the value $\lambda_1$=0.77.

The ionization current, which is equivalent to $ci_1$=0.45 μA as well as the difference $\Delta_1$ between the values of the ionization current ($ci_1$−$ci_0$)=0.15 μA, is then measured.

If $\Delta_1$ is smaller than $\Delta_{rif}$, it can be deemed that $\lambda_1$ corresponds to a correct carburetion.

However, in order to obtain a better adjustment of the carburetion, it is advisable to repeat the operation with values of $\lambda_{1 \ldots n}$ of up to when the difference between the last measured and the second last measured ionization current ($ci_n$ and $ci_{n-1}$) exceeds the value $\Delta_{rif}$.

The second last value $\lambda_{n-1}$ is restored at this point and this value is considered the correct value.

This enables selecting, from among acceptable values of $\lambda$, the one closest to the rich mixture.

It is understood that the invention is not restricted to the previously described example and that it may be subjected to variants and improvements without departing from the scope of protection of the claims that follow.

The invention claimed is:

1. A system for controlling the carburetion of an internal combustion engine comprising the following activities:

a. starting the engine;

b. defining a value $\lambda_0$ of a lambda factor $\lambda$;

c. measuring a value $ci_0$ of an ionization current;

d. modifying the lambda factor $\lambda$ by a predefined amount equivalent to $\Delta_{\lambda}$ thereby changing the lambda factor to the value $\lambda_1=\lambda_0+\Delta_{\lambda}$;

e. repeating the measurement of the ionization current to get a second value $ci_1$ thereof;

f. calculating a value of a difference $\Delta_{\lambda ci1}$ of the ionization current equivalent to $ci_0$−$ci_1$;

g. repeating operations d. and e., thereby measuring the ionization current with different values $\lambda_{1 \ldots n}$, until a difference between a last value of the ionization current $ci_n$ and a second to last value of the ionization current $ci_{n-1}$ is smaller than $\Delta_{ci}$, where $\Delta_{ci}$ is a predefined value which is assumed to have no influence with respect to the carburetion; and h. restoring a second to last value $\lambda_{n-1}$ as the corrected value.

2. The control system according to claim 1 wherein $\lambda_0$ is the value of the lambda factor $\lambda$ of the engine calibrated according to predetermined factory operating conditions.

3. The control system according to claim 1 wherein $ci_0$ is the value of the ionization current of the engine calibrated according to predetermined factory operating conditions.

4. The control system according to claim 1 wherein $\Delta_{ci}$ is comprised between 0.6 ρA and 0.7 ρA.

5. The control system according to claim 1 wherein $\lambda_0$ is comprised between 0.8 and 1.

* * * * *